United States Patent [19]

Hofmann et al.

[11] Patent Number: 4,711,185

[45] Date of Patent: Dec. 8, 1987

[54] PROCESS AND APPARATUS FOR THE DECOMPOSITION OF HALOGEN AND/OR PHOSPHORIC CONTAINING ORGANIC MATERIALS

[75] Inventors: Jürgen Hofmann, Bad Orb; Hans Huschka, Hanau; Daniel Neupert, Karlstein, all of Fed. Rep. of Germany

[73] Assignee: Nukem GmbH, Hanau, Fed. Rep. of Germany

[21] Appl. No.: 287,120

[22] Filed: Jul. 27, 1981

[30] Foreign Application Priority Data

Jul. 25, 1980 [DE] Fed. Rep. of Germany ..... 3028193

[51] Int. Cl.[4] ..... F23G 7/00; F23B 7/00; G21F 9/14

[52] U.S. Cl. ..... 110/215; 110/237; 110/342; 110/210; 110/238; 110/346; 252/626; 252/632; 431/7

[58] Field of Search ..... 252/626, 632, 631; 110/237, 238, 346, 215, 342, 210; 431/7

[56] References Cited

U.S. PATENT DOCUMENTS

| | | | |
|---|---|---|---|
| 3,556,024 | 1/1971 | Fuller et al. | 110/346 |
| 3,814,568 | 6/1974 | Whittman | 110/238 |
| 4,277,362 | 7/1981 | Mallek et al. | 252/632 |
| 4,352,332 | 10/1982 | Baston | 252/629 |

FOREIGN PATENT DOCUMENTS

| | | |
|---|---|---|
| 2855650 | 7/1980 | Fed. Rep. of Germany . |
| 1517014 | 7/1978 | United Kingdom . |

*Primary Examiner*—John F. Terapane
*Assistant Examiner*—Howard J. Locker
*Attorney, Agent, or Firm*—Cushman, Darby & Cushman

[57] ABSTRACT

There is needed a process and an apparatus for the pyrolytic decomposition of halogen and/or phosphorus containing organic materials, particularly those which are radioactive, in which no corrosive secondary products, minimal amounts of waste gas, small amounts of dust and conditionable active solid waste form. This is accomplished by mixing the materials in an over stoichiometric ratio with basis compounds and introducing them from above in the form of a suspension into a fixed bed reactor which is charged with mechanically agitated substantially spherical ceramic structures.

2 Claims, 1 Drawing Figure

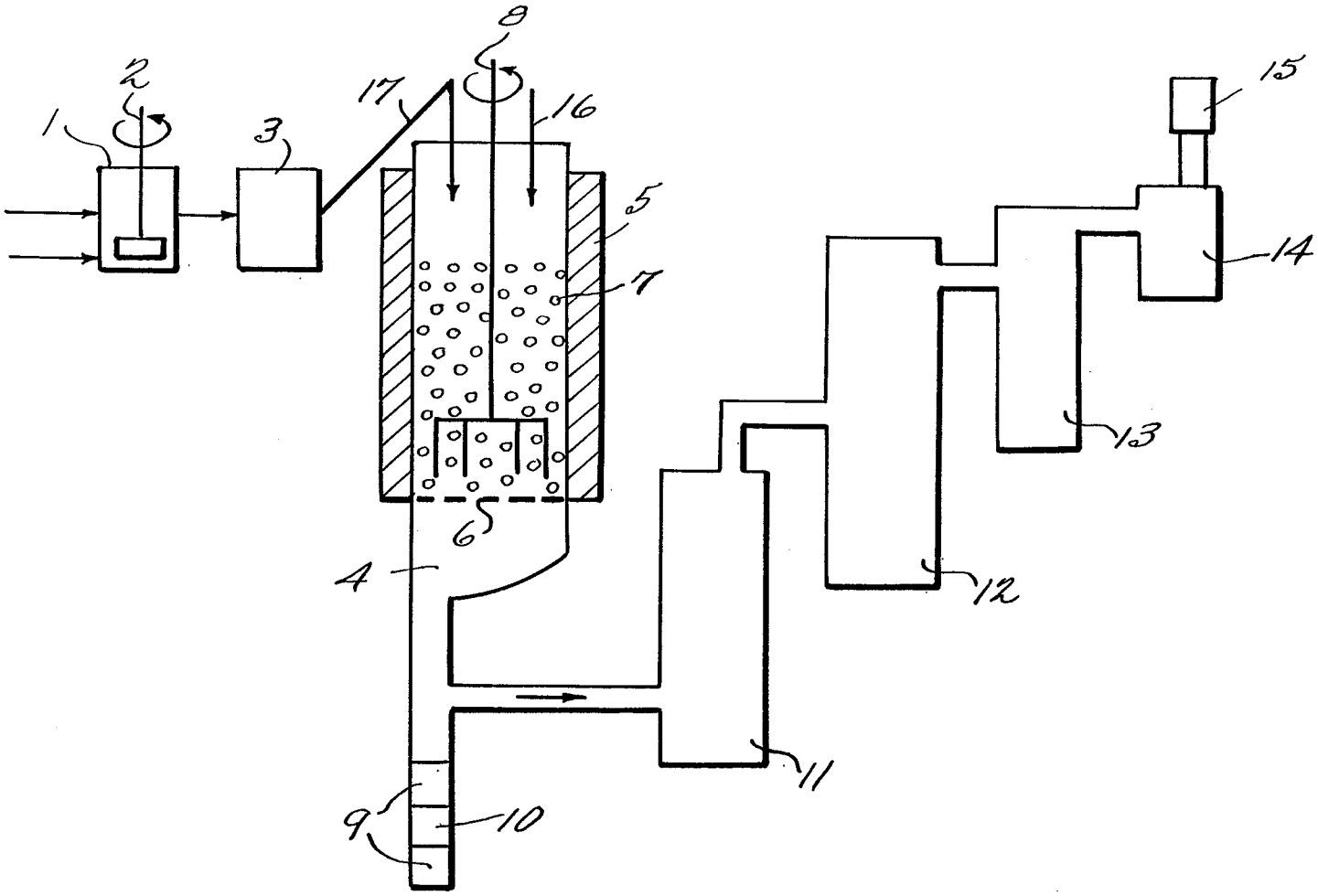
1
2
3
4
5
6
7
8
9
10
11
12
13
14
15
16
17

PROCESS AND APPARATUS FOR THE DECOMPOSITION OF HALOGEN AND/OR PHOSPHORIC CONTAINING ORGANIC MATERIALS

BACKGROUND OF THE INVENTION

The invention is directed to a process and apparatus for the pyrolytic decomposition of organic materials, particularly radioactively contaminated organic materials, containing a halogen (Cl, Br, F, I) and/or phosphorus at 300° to 800° C. in a reactor.

In the nuclear art there are a number of contaminated organic solvent and extraction agents which must be removed.

The chief amount of contaminated organic materials which must be removed consists of a mixture of tributyl phosphate (TBP) and kerosene, which for example is employed in the volume ratio 30:70 as extraction agent in the reprocessing of spent fuel elements according to the PUREX process.

At other places in the nuclear art, e.g. in the organic conversion of $UF_6$ to $UF_4$ perchloroethylene is obtained as waste in admixture with partially fluorinated products, which likewise must be eliminated.

However, also in the conventional area there are wastes of fluorinated, chlorinated and phosphorus containing solvents which cannot be burned without problems or, if they are not burnable, cannot by pyrolyzed without problem, since in this case, especially in the hot, they develop extraordinarily corrosive and environmentally undesirably acting phosphoric acid, hydrogen chloride and hydrogen fluoride.

In the conventional area the elimination of these materials generally take place in an environmentally undesirable manner by burning on combustion ships on the high seas. In the case of radioactively contaminated waste from the point of view of the political environmental burning on the high seas is essentially intolerable.

Therefore waste from the nuclear art must be conveyed with substantially stronger safety precautions into the final storable condition. There are included in these safety precautions that the waste on the one hand must be reduced to the smallest possible volume and on the other hand that the process for the reduction operates with high decontamination factors and the smallest possible secondary waste. The waste occurring in the nuclear art of the categories considered consists essentially of TBP/kerosene.

Several processes or process variants are described and have been listed especially for removal of TBP/kerosene.

It is disadvantageous that in the burning on the one hand $P_2O_5$, which is a glass former, forms and very quickly leads to clogging in the waste gas system of the combustion plant through the formation of phosphate glasses. On the other hand in the middle temperature range by reaction with the water of reduction that arises, it forms phosphoric acid which because of its extraordinary corrosiveness causes damage to metallic parts of the plants (W. Bahr, W. Hempelmann and H. Krause, KfK-2418, February 1977).

Furthermore there was tried burning in a $Na_2CO_3$ melt for the removal of TBP or TBP/kerosene mixture. Hereby there takes place an in situ neutralization of the $P_2O_5$ or phosphoric acid. However, there forms high melting metaphosphate which can lead to handling problems (D. L. Ziegler, A. J. Johnson, Proceedings 14th ERDA Air Cleaning Conference, February 1977).

In British patent No. 1517014 there is described a process for handling contaminated TBP/kerosene wastes in which first the TBP is separated from kerosene with phosphoric acid and then the adduct formed is thermally decomposed at about 200° C. to phosphoric acid and butene. The butene is burned, the highly active phosphoric acid precipitated with calcium hydroxide and the calcium phosphate formed conveyed to final storage. The additional introduction into the process of phosphoric acid which is necessary for the formation of adduct produces additional secondary waste which is a particular disadvantage of this process.

Besides there is described a process (German OS No. 2855650 and related Vietzke U.S. application Ser. No. 104,736 filed Dec. 19, 1979, the entire disclosure of which is hereby incorporated by reference and relied upon), a process in which the TBP/kerosene mixture is reacted in a fluidized bed which uses the simultaneous presence of a basic granulate as fluidized material. Hereby there takes place reaction of the TBP to phosphoric acid and a mixture of butene and butanol. Kerosene distills off and in the presence of excess warm steam can be burned together with the butene and butanol. The phosphoric acid is bound through the basic materials, preferably CaO or $Ca(OH)_2$, present as the fluidizing material, as insoluble phosphates which are drawn off from the fluidized bed reactor and are conveyed to the final storage. Certainly in a fluidized bed normally there is needed an increased amount of reaction gas which leads to an increased amount of waste gas and to development of dust in the reaction space, which can have a significant influence on the stream time of the filter candles at the outlet of the reactor. Besides there is produced radioactively contaminated water which must be worked up in an additional process step.

Therefore it was the problem of the present invention to develop a process and an apparatus for the pyrolytic decomposition of halogen (i.e. Cl, Br, F, or I) and/or phosphorus containing organic materials, especially radioactively contaminated organic materials, at 300° to 800° C. in a reactor so that all mixtures of organic materials can be worked up without formation of corrosive, secondary products, at minimal amounts of waste gas, low dust development in the reactor and simultaneously high decontamination factors. Furthermore, as residue in the reactor, there should be obtained the most inert inorganic product possible, preferably readily conditionable in cement.

SUMMARY OF THE INVENTION

This problem was solved according to the invention by mixing the materials in an overstoichiometric ratio with basic compounds and introducing them from above in the form of a suspension into a fixed bed reactor which is charged with mechanically agitated, substantially spherical ceramic structures.

Illustrative examples of halogen and/or phosphorus containing organic compounds are tributyl phosphate, tricresyl phosphate, 2-chloroethyl phosphate, tributyl phosphite, triphenyl phosphate, triphenyl phosphite, 1,2-dichloro-1,1,2,2-tetrafluoroethane, 1,2-difluoro, 1,1,2,2-tetrachloroethane, carbon tetrafluoride, carbon tetrachloride, carbon tetrabromide, methyl iodide, chloroform, fluoroform, bromoform, dichlorodifluoromethane, propyl chloride, ethylene dichloride, ethylene bromide, trichloroethylene, dichloroethylene.

BRIEF DESCRIPTION OF THE DRAWINGS

The single view of the drawings schematically shows a preferred form of the apparatus used to carry out the invention.

The process of the invention will be disclosed in more detail, in connection with the preferred apparatus.

Referring more specifically to the drawings the liquid waste mixture, e.g. tributyl phosphate (TBP)/kerosene was stirred to a suspension in a mixing container 1 having a scant overstoichiometric amount of $Ca(OH)_2$ or $Mg(OH)_2$ and the suspension maintained with the help of a stirrer 2. The waste suspension by way of a metering pump 3 and via a supply line 17 was fed vertically from above into a fixed bed reaction. The fixed bed reactor was heated indirectly from the outside by a resistance oven 5. A sieve plate 6 is mounted in the lower part of the reactor. A charge of spherical ceramic structures 7 is preferably made of expanded (bloated) clay, located on this sieve plate. During the feeding in of the waste the expanded clay charge was continuously moved slightly by means of stirrer 8 and in order to convey the gaseous constituents in the direction of the after burner chamber a nitrogen stream is led at a velocity of 3–5 cm/sec via the supply line 16 through the reactor 4. The reaction of the phosphorus and/or halogen containing liquid waste to calcium phosphate, chloride or fluoride takes place in and on the expanded clay charge. The reaction products of the phosphoric acid, hydrogen chloride, and hydrogen fluoride which in the free state are strongly corrosive pour through the expanded clay charge 7 and the sieve plate 6 in the form of powder and can be drawn off at the lower part of the fixed bed reactor 4 discontinuously via the sluice 10 between the two ball valves 9. The reaction gases go into the after burner chamber 11 where they are burned with a scant overstoichiometric amount of air or oxygen to $CO_2$ and water, preferably at about 1000° C.

For safety there is post connected to the after burner chamber 11 a washer 12 which operates at a pH of about 5, in order to separate off if necessary small amounts of HCl and/or HF present in the waste gas, while $CO_2$ at this pH passes the washes. In the subsequent condenser chamber 13 the condensation of the residual steam present takes place and the residual water-aerosol is separated off at the fiber deep bed filter 14. The waste gas by this time passing over an S-filter 15 only consists of $CO_2$.

As basic compounds above all calcium hydroxide, calcium oxide, magensium hydroxide, and magnesium oxide have proven effective. However, there can be used other basic compounds. The ceramic charge consists substantially of spherical particles, but there can also be used particles which deviate from the spherical shape and for example are elliptical. The particles advantageously have a size of 10–30 mm. The reaction products do not deposit on these particles because of the mechanical movement of the particles, but fall through the charge and can be drawn off at the lower part of the fixed bed reactor.

Preferably there is used for the charge expanded clay but there can also be employed other ceramic materials.

Unless otherwise indicated all parts and percentages are by weight.

The process can comprise, consist essentially of, or consist of the steps set forth using compositions which can comprise, consist essentially of or consist of the materials set forth.

The invention will be further explained in connection with the following examples.

DESCRIPTION OF THE PREFERRED EMBODIMENTS

EXAMPLE 1

There were stirred to a suspension in container 1 10 liters of TBP/kerosene (30/70 by volume) (which were doped with 3.6 grams of highly enriched uranium (93% U-235) in the form of a uranyl nitrate solution) with 1000 grams of $Ca(OH)_2$ powder and with the help of the metering pump 3 the mixture was fed into the reactor 4 having a reaction temperature of 500° C. in the course of 2 hours. In the reactor 4 there are located 2 kg of a charge of expanded clay balls 7 having a diameter of 15–30 mm which balls are slightly moved with the help of the stirrer 8 rotating at 1 revolution per minute. After ending the experiment there were drawn off via the sluice 10 1.5 kg of an ash consisting chiefly of calcium diphosphate and this ash was collected in an ash collection container.

The combustible waste gases escaping from the reaction were after burned with a slight excess of air in the after burner chamber 11 and the after burner gases washed in the washer 12 with water. After the end of the experiment there was accumulated in the circulating water of the washer 12 0.015% of the activity fed in in the form of highly enriched uranium in the reactor 4. The phosphate content in the wash cycle was 30 ppm. The radiometric activity measurements in the waste air channel behind the S-filter 15 was in the region of zero.

EXAMPLE 2

There were stirred to a suspension in the receiving container 1 10 kg of the fluorohydrocarbon $C_2F_2Cl_4$ (specifically 1,2-difluoro1,1,2,2-tetrachloroethane) with 11.5 kg of $Ca(OH)_2$. This suspension was doped with 3.6 grams of highly enriched uranium (93% U-235) in the form of a uranyl nitrate solution and subsequently via the metering pump 3 in the course of 2 hours fed into the reactor 7 having a reaction temperature of 570° C. There were located in the reactor 2 kg of a charge of expanded clay spheres 7 having a diameter of 15–30 mm, which charge was moved with the help of stirrer 8. After the end of the experiment there were drawn off over the sluice 10 15.5 kg of ash collected, chiefly of $CaCl_2$ and $CaF_2$ as well as excess calcium oxide and this mixture was collected in the ash collection container 2.

The combustible waste gas escaping from the reactor was burned in the after burner chamber 11 with a slight excess of air and the waste gas escaping from the after burner chamber was scrubbed with water in washer 12.

After the end of the experiment there was accumulated in the circulating water of the washer 12 0.02% of the activity in the form of highly enriched uranium in the reactor 4. The radioactivity measurements in the waste gas channel behind the S-filter were in the region of the zero point.

The entire disclosure of German priority application No. P 3028193.7-33 is hereby incorporated by reference.

What is claimed is:

1. An apparatus suitable for the pyrolytic decomposition of an organic compound containing at least one element from the group consisting of halogen and phosphorus present in a waste material comprising a fixed bed reactor, a charge of substantially spherical ceramic structures resting on a sieve plate in said reactor, means for mechanically stirring said charge, means for supplying the organic compound into the upper part of the reactor, means for separately discharging the reaction gases and the solid reaction product formed in the reactor at the lower part of the reactor.

2. An apparatus according to claim 1 including in combination a container with mixing means, adapted to prepare a suspension of the waste material, means for pumping the suspension from said container to said reactor, an after burner chamber connected to the discharge portion of said reactor, means for washing the material leaving the after burner chamber, condensing means for condensing the less volatile material leaving said washer and means for filtering the material after the condensing means.

* * * * *